US011062869B2

(12) United States Patent
Kishi et al.

(10) Patent No.: US 11,062,869 B2
(45) Date of Patent: Jul. 13, 2021

(54) TEMPERATURE SENSITIVE PELLET TYPE THERMAL FUSE

(71) Applicant: SCHOTT Japan Corporation, Koka (JP)

(72) Inventors: Eigo Kishi, Koka (JP); Akira Nakanishi, Koka (JP); Tamotsu Wakabayashi, Koka (JP); Tokihiro Yoshikawa, Koka (JP)

(73) Assignee: SCHOTT Japan Corporation, Koka (JP)

( * ) Notice: Subject to any disclaimer, the term of this patent is extended or adjusted under 35 U.S.C. 154(b) by 0 days.

(21) Appl. No.: 16/631,322

(22) PCT Filed: Dec. 11, 2018

(86) PCT No.: PCT/JP2018/045530
§ 371 (c)(1),
(2) Date: Jan. 15, 2020

(87) PCT Pub. No.: WO2019/117153
PCT Pub. Date: Jun. 20, 2019

(65) Prior Publication Data

US 2020/0144013 A1 May 7, 2020

(30) Foreign Application Priority Data

Dec. 12, 2017 (JP) ..... JP2017-237626
Dec. 3, 2018 (JP) ..... JP2018-226682

(51) Int. Cl.
*H01H 85/055* (2006.01)
*H01H 85/041* (2006.01)
(Continued)

(52) U.S. Cl.
CPC ..... *H01H 85/055* (2013.01); *H01H 85/041* (2013.01); *H01H 85/06* (2013.01);
(Continued)

(58) Field of Classification Search
CPC .. H01H 85/055; H01H 85/175; H01H 85/143; H01H 85/041; H01H 2235/01; H01H 85/17; H01H 85/06
(Continued)

(56) References Cited

U.S. PATENT DOCUMENTS 3,727,164 A * 4/1973 Cartier ..... H01H 37/765 337/405
4,197,520 A * 4/1980 Smith ..... H01H 37/765 337/407
(Continued)

FOREIGN PATENT DOCUMENTS

JP 57-007036 A 1/1962
JP 54-103534 U 7/1979
(Continued)

OTHER PUBLICATIONS

English translation of the International Search Report of the International Searching Authority for International Application PCT/JP2018/045530, dated Feb. 26, 2019, 2 pages, Japan Patent Office, Tokyo, Japan.
(Continued)

*Primary Examiner* — Stephen S Sul
(74) *Attorney, Agent, or Firm* — W. F. Fasse

(57) ABSTRACT

The temperature sensitive pellet type thermal fuse includes: a conductive envelope having an opening at a first end; a temperature sensitive device housed inside the envelope; a first lead which is installed in the opening of the envelope and has a fixed contact; a second lead connected to a second end of the envelope; a movable contact housed in the envelope; and a weak compression spring housed in the envelope. The temperature sensitive device includes a cylindrical case having an open end which may be arranged at the side of the first lead, a temperature sensitive material housed in the cylindrical case, and a strong compression spring
(Continued)

configured to press against the temperature sensitive material.

32 Claims, 11 Drawing Sheets

(51) Int. Cl.
*H01H 85/06* (2006.01)
*H01H 85/143* (2006.01)
*H01H 85/17* (2006.01)
*H01H 85/175* (2006.01)

(52) U.S. Cl.
CPC ..... *H01H 85/143* (2013.01); *H01H 85/17* (2013.01); *H01H 85/175* (2013.01); *H01H 2235/01* (2013.01)

(58) Field of Classification Search
USPC ..... 337/148, 186, 195, 317
See application file for complete search history.

(56) References Cited

U.S. PATENT DOCUMENTS 4,322,705 A * 3/1982 Hara ..... H01H 37/765 337/407
4,825,187 A * 4/1989 Cenky ..... H01H 37/765 337/407
5,003,283 A * 3/1991 Cenky ..... H01H 11/00 337/403
5,159,309 A * 10/1992 Bayer ..... H01H 37/764 337/354
5,473,303 A * 12/1995 Hohider ..... H01H 1/02376 337/401
5,530,417 A * 6/1996 Hohider ..... H01H 1/06 200/239
7,323,965 B2 * 1/2008 Yoshikawa ..... H01H 37/765 337/159
2005/0088272 A1 * 4/2005 Yoshikawa ..... H01H 37/765 337/401
2006/0208845 A1 * 9/2006 Yoshikawa ..... H01H 37/765 337/159
2006/0232372 A1 * 10/2006 Yoshikawa ..... H01H 37/767 337/401
2007/0236324 A1 * 10/2007 Yoshikawa ..... H01H 37/765 337/401
2012/0255162 A1 * 10/2012 Tamura ..... H01H 37/765 29/623
2013/0334471 A1 * 12/2013 Hinrichs ..... H01B 1/12 252/519.3
2015/0091689 A1 * 4/2015 Nguyen ..... H01H 85/44 337/298
2016/0006235 A1 * 1/2016 Wang ..... H01H 85/08 361/91.2
2016/0336136 A1 * 11/2016 Kim ..... H01H 37/765
2017/0345602 A1 11/2017 Yoon et al.
2017/0345603 A1 * 11/2017 Yoon ..... H01H 85/10

FOREIGN PATENT DOCUMENTS

JP 57-107253 U 7/1982
JP 01-154422 A 6/1989
JP 02-005844 U 1/1990
JP 2003-147461 A 5/2003
JP 2005-158681 A 6/2005
JP 2011-204516 A 10/2011

OTHER PUBLICATIONS

PCT International Preliminary Report on Patentability including English Translation of PCT Written Opinion of the International Searching Authority for International Application PCT/JP2018/045530, dated Jun. 16, 2020, 15 pages, International Bureau of WIPO, Geneva, Switzerland.

* cited by examiner (a)

(b)

TEMPERATURE SENSITIVE PELLET TYPE THERMAL FUSE

TECHNICAL FIELD

The present disclosure relates to a temperature sensitive pellet type thermal fuse configured to break an electric circuit when an overheat of an electric device or the like is detected.

BACKGROUND ART

Thermal fuses are used in home appliances, industrial electrical devices and industrial electronic devices. The thermal fuse is a protective component that senses the temperature of a device and quickly breaks an electric circuit when the device is abnormally overheated. Thermal fuses are installed in products such as home appliances, portable devices, communication devices, office equipments, in-vehicle devices, AC adapters, chargers, motors, and batteries, for example.

There are various types of thermal fuses, and such a thermal fuse generally has a rated current of approximately 0.5 A to approximately 15 A. A temperature sensitive pellet type thermal fuse is suitably used as a thermal fuse for a high rated current of 6 A or more. Such a temperature sensitive pellet type thermal fuse is disclosed in Japanese Patent Laying-Open No. 01-154422 (PTL 1).

The temperature sensitive pellet type thermal fuse disclosed in PTL 1 includes a hollow cylindrical metal case (hereinafter referred to as an envelope), a first lead and a second lead which are disposed at one end and the other end of the envelope, respectively, temperature sensitive pellets arranged in contact with the second lead, and a movable contact which is in contact with the first lead via the temperature sensitive pellets and biased in the separation direction. When the temperature of an electric device installed with the temperature sensitive pellet type thermal fuse reaches a predetermined temperature or more, the temperature sensitive pellet melts or softens. As a result, the movable contact is separated from the first lead by the biasing force, and thereby the circuit is broken.

The temperature sensitive pellet type thermal fuse is connected in series to the electric device, and the electric device is supplied with power or distributes power through the intermediary of the temperature sensitive pellet type thermal fuse. The temperature sensitive pellet type thermal fuse is installed at a position where it is desired to detect an abnormal temperature rise of the electric device.

The temperature sensitive pellet is solid at normal temperature, and the movable contact is pressed against and brought into contact with the end of the first lead by the biasing force while the temperature sensitive pellet is solid. Thereby, the first lead, the movable contact, the envelope, and the second lead are maintained in the conductive state. When the temperature of the position where temperature sensitive pellet type thermal fuse is installed rises to the operating temperature of the temperature sensitive pellet type thermal fuse due to abnormal flow of current such as a short circuit of the electric device, the temperature sensitive pellets will melt. After the temperature sensitive pellets are melted, the biasing force that presses the movable contact against the end of the first lead decreases. When the biasing force decreases, the movable contact is separated from the end of the first lead, and a non-conductive state is established between the first lead and the second lead. As a result, the supply of power to the electric device or the distribution of power by the electric device is stopped so as to prevent the temperature of the electric device from further rising, which makes it possible to prevent electric device from getting overheated or prevent an accident such as fire from occurring due to the overheating.

CITATION LIST

Patent Literature

PTL 1: Japanese Patent Laying-Open No. 01-154422
PTL 2: Japanese Patent Laying-Open No. 2005-158681
PTL 3: Japanese Patent Laying-Open No. 2003-147461

SUMMARY OF INVENTION

Technical Problem

For example, Japanese Patent Laying-Open No. 2005-156681 (PTL 2) describes a temperature sensitive pellet type thermal fuse that uses an organic material which has a melting point or deformation temperature as the temperature sensitive material, and the temperature sensitive material is processed into pellets. On the other hand, for example, Japanese Patent Laying-Open No. 2003-147461 (PTL 3) describes a meltable alloy type thermal fuse that uses an inorganic material as the temperature sensitive material. A conductive metal material such as solder is used as the inorganic temperature sensitive material. However, such temperature sensitive material can not be used in the temperature sensitive pellet type thermal fuse having a cylindrical metal envelope, since the temperature sensitive material flows in the metal envelope after melting, which prevents the contacts from being separated from each other.

An object of the present disclosure is to provide a temperature sensitive pellet type thermal fuse superior in reliability.

Solution to Problem

The temperature sensitive pellet type thermal fuse in the present disclosure includes: a conductive envelope which is provided with an opening at a first end; a temperature sensitive device which is housed inside the envelope and configured to be thermally actuated at a predetermined temperature; a first lead which is installed in the opening of the envelope in electrical insulation with the envelope and has a fixed contact; a second lead which is connected to a second end of the envelope; a movable contact which is housed in the envelope and configured to be pressed by the temperature sensitive device so as to abut the fixed contact; and a weak compression spring which is housed in the envelope and configured to press the movable contact in the direction of separating the movable contact from the fixed contact. The temperature sensitive device includes: a cylindrical case which is provided with an open end; a temperature sensitive material which is housed in the cylindrical case and configured to melt at a predetermined operating temperature; and a strong compression spring which is configured to press against the temperature sensitive material so as to bring the movable contact into contact with the fixed contact.

In the temperature sensitive pellet type thermal fuse, the open end of the temperature sensitive device may be arranged at the side of the second lead.

In the temperature sensitive pellet type thermal fuse, the heat sensitive device may be provided with a lid arranged at the side of the open end the cylindrical case.

In the temperature sensitive pellet type thermal fuse, the heat sensitive material may be made of a conductive metal material.

In the temperature sensitive pellet type thermal fuse, a push plate may be disposed between the temperature sensitive material and the strong compression spring.

In the temperature sensitive pellet type thermal fuse, the push plate may be provided with a projection on a contact surface in contact with the temperature sensitive material.

In the temperature sensitive pellet type thermal fuse, the push plate may be provided with a projection on a contact surface in contact with the strong compression spring.

In the temperature sensitive pellet type thermal fuse, the lid may be disposed to be sandwiched between the temperature sensitive material and the strong compression spring.

In the temperature sensitive pellet type thermal fuse, the lid may be provided with a projection on the contact surface in contact with the strong compression spring.

In the temperature sensitive pellet type thermal fuse, at least a portion of the lid in contact with the cylindrical case may be made of an elastic material.

In the temperature sensitive pellet type thermal fuse, the elastic material may be made of a polymer material or a metal material.

In the temperature sensitive pellet type thermal fuse, the lid may be made of a composite material of an inorganic chemical material and a polymer material.

In the temperature sensitive pellet type thermal fuse, the lid may be made of a composite material of a metal material and a polymer material.

In the temperature sensitive pellet type thermal fuse, at least a portion of the lid in contact with the cylindrical case may be insert-molded.

In the temperature sensitive pellet type thermal fuse, at least a portion of the lid in contact with the cylindrical case may be elastically coated.

In the temperature sensitive pellet type thermal fuse, the lid may be dish-shaped or cap-shaped.

In the temperature sensitive pellet type thermal fuse, the lid may be configured to close at least the open end of the cylindrical case after operation.

In the temperature sensitive pellet type thermal fuse, the lid or the cylindrical case may be made of a material which is hard to be wetted by the melted temperature sensitive material.

In the temperature sensitive pellet type thermal fuse, the lid or the cylindrical case may be made of a material which is non-reactive or hardly reactive to the temperature sensitive material.

In the temperature sensitive pellet type thermal fuse, the lid or the cylindrical case may be made of nonmagnetic or weak magnetic material.

In the temperature sensitive pellet type thermal fuse, the lid or the cylindrical case may be made of a polymer material, aluminum, aluminum alloy, alumite, stainless steel, Fe—Ni alloy, a ceramic material, nickel, or chromium.

In the temperature sensitive pellet type thermal fuse, at least a portion of the lid or the cylindrical case in contact with the temperature sensitive material may be made of a polymer material, aluminum, aluminum alloy, alumite, stainless steel, Fe—Ni alloy, a ceramic material, nickel or chromium.

In the temperature sensitive pellet type thermal fuse, the temperature sensitive material may be made of pure tin or any one alloy of 67In-32.4Sn-0.6Cu alloy, 56.5Bi-41.9Sn-1In-0.6Cu alloy, 57Bi-43Sn alloy, 52Bi-43Sn-5Sb alloy, 91.2Sn-8.8Zn alloy, 92.5Sn-4In-3Ag-0.5Bi alloy, 96.5Sn-3.5Ag alloy, 99.8Sn-0.2Cu alloy, 95Sn-5Sb alloy, 90Pb-10Sb alloy, 99.3Bi-0.5Ag-0.2Cu alloy, 97Bi-3Ag alloy, 88.6Pb-9.5In-1Sn-0.9Ag alloy, 98Pb-1.8Ag-0.2Sn alloy, 93Zn-4Al-3Mg alloy, and 95Zn-5Al alloy.

In the temperature sensitive pellet type thermal fuse, the temperature sensitive material may be in the shape of a cone or a truncated cone.

In the temperature sensitive pellet type thermal fuse, an upper portion of the temperature sensitive material in the shape of a cone or a truncated cone may be fitted in a hole of the strong compression spring.

In the temperature sensitive pellet type thermal fuse, when the inner diameter of the cylindrical case is set to 1, the outer diameter of the strong compression spring may be in the range of 0.90 to 0.97.

In the temperature sensitive pellet type thermal fuse, the push plate may be configured to control at least one of a flow direction, an ejection amount and an ejection position of the melted temperature sensitive material.

In the temperature sensitive pellet type thermal fuse, the push plate may be provided with at least one flow hole.

In the temperature sensitive pellet type thermal fuse, the push plate may have a polygonal shape, a star shape or a flower shape.

In the temperature sensitive pellet type thermal fuse, the push plate may be provided with a notch at least at an outer peripheral portion thereof.

In the temperature sensitive pellet type thermal fuse, the push plate may have rounded corners so that it is difficult to be caught in the cylindrical case.

In the temperature sensitive pellet type thermal fuse, the open end of the cylindrical case of the temperature sensitive device may be arranged at the side of the first lead.

Advantageous Effects of Invention

According to one embodiment of the present disclosure, when the fuse is in operation, it is possible to reliably break the flow of current.

DESCRIPTION OF EMBODIMENTS

Figure 1:
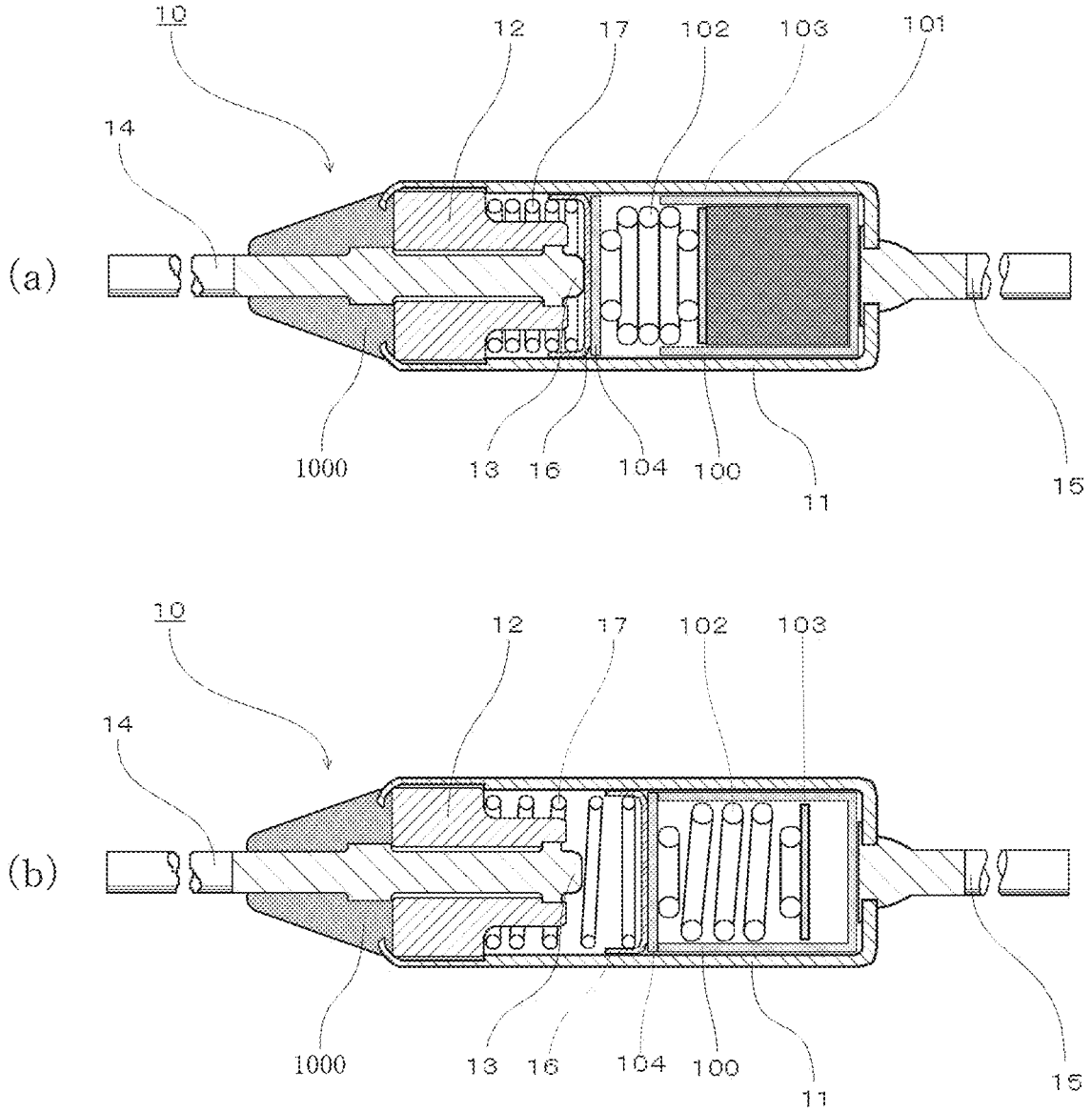
FIG. 1(*a*) is a cross-sectional view illustrating a temperature sensitive pellet type thermal fuse 10 according to an embodiment of the present disclosure before operation, and FIG. 1(*b*) is a cross-sectional view illustrating the temperature sensitive pellet type thermal fuse 10 after operation without depicting the temperature sensitive material.

According to a first aspect of the present disclosure, a temperature sensitive pellet type thermal fuse includes a conductive envelope which is provided with an opening at a first end, a temperature sensitive device which is housed inside the envelope and configured to be thermally actuated at a predetermined temperature, a first lead which is installed in the opening of the envelope in electrical insulation with the envelope and has a fixed contact, a second lead which is connected to a second end of the envelope, a movable contact which is housed in the envelope and configured to be pressed by the temperature sensitive device so as to abut the fixed contact, and a weak compression spring which is housed in the envelope and configured to press the movable contact in the direction of separating it from the fixed contact.

The temperature sensitive device includes at least a cylindrical case, a temperature sensitive material which is housed in the cylindrical case and configured to melt at a predetermined operating temperature, a strong compression spring which is configured to press against the temperature sensitive material so as to bring the movable contact into contact with the fixed contact, and a lid configured to be sandwiched between the temperature sensitive material and the strong compression spring.

The strong compression spring may be selectively configured as pressing the temperature sensitive material directly or pressing the temperature sensitive material via a push plate interposed therebetween. In one preferred configuration, in order to prevent the melted temperature sensitive material from leaking out of the cylindrical case, at least a contact surface of at least the lid or the cylindrical case (and the push plate where necessary) that is in contact with the temperature sensitive material is made of a material (for example, aluminum, aluminum alloy, stainless steel, Fe—Ni alloy, a ceramic material, nickel, chromium) which is hard to be wetted by the melted temperature sensitive material.

In order to prevent the lid or the cylindrical case (and the push plate where necessary) from interacting with the other components of the thermal fuse or the peripheral members other than the thermal fuse due to the magnetic influence of the surroundings such as magnetic restraint or electromagnetic induction heating, it is more preferable that the lid or the cylindrical case (and the push plate where necessary) is made of a nonmagnetic or weak magnetic material.

The lid and the cylindrical case are configured to be just brought into contact with each other when the strong compression spring and the weak compression spring are extended. Thereby, the lid is prevented from being strongly pressed against the cylindrical case after operation, which makes it possible to prevent the lid from tilting adversely.

According to a second aspect of the present disclosure, a temperature sensitive pellet type thermal fuse includes a conductive envelope which is provided with an opening at one end, a temperature sensitive device which is housed inside the envelope and configured to be thermally actuated at a predetermined temperature, a first lead which is installed in the opening of the envelope in electrical insulation with the envelope and has a fixed contact at its inner end, a second lead which is connected to a second end of the envelope, a movable contact which is housed in the envelope and configured to be pressed by the temperature sensitive device so as to abut the fixed contact, and a weak compression spring which is housed in the envelope and configured to press the movable contact in the direction of separating it from the fixed contact.

The temperature sensitive device includes at least a cylindrical case configured to close an open end thereof by pressing it against the inner end of the envelope when the thermal fuse is in operation, a temperature sensitive material which is housed in the cylindrical case and configured to melt at a predetermined operating temperature, and a strong compression spring which is configured to press against the temperature sensitive material so as to bring the movable contact into contact with the fixed contact.

The strong compression spring may be selectively configured as pressing the temperature sensitive material directly or pressing the temperature sensitive material via a push plate interposed therebetween. In one preferred configuration, in order to prevent the melted temperature sensitive material from leaking out of the cylindrical case, at least the cylindrical case or the push plate is made of a material (for example, a polymer material, aluminum, aluminum alloy, alumite, stainless steel, Fe—Ni alloy, a ceramic material, nickel, chromium) that is hard to be wetted by the melted temperature sensitive material.

In order to prevent the cylindrical case or the push plate from interacting with the other components of the thermal fuse or the peripheral members other than the thermal fuse due to the magnetic influence of the surroundings such as magnetic restraint or electromagnetic induction heating, it is more preferable that the cylindrical case or the push plate is made of a nonmagnetic or weak magnetic material.

According to a third aspect of the present disclosure, a temperature sensitive pellet type thermal fuse includes a conductive envelope which is provided with an opening at one end, a temperature sensitive device which is housed inside the envelope and configured to be thermally actuated at a predetermined temperature, a first lead which is installed in the opening of the envelope in electrical insulation with the envelope and has a fixed contact at its inner end, a second lead which is connected to a second end of the envelope, a movable contact which is housed in the envelope and configured to be pressed by the temperature sensitive device so as to abut the fixed contact, and a weak compression spring which is housed in the envelope and configured to press the movable contact.

The temperature sensitive device includes at least a cylindrical case, a temperature sensitive material which is housed in the cylindrical case and configured to melt at a predetermined operating temperature, a strong compression spring which is configured to press against the temperature sensitive material so as to bring the movable contact into contact with the fixed contact, and a lid configured to be sandwiched between the temperature sensitive material and the strong compression spring.

In a more preferable embodiment, in order to prevent the melted temperature sensitive material from leaking out of the cylindrical case, at least the lid or the cylindrical case is made of a material which is hard to be wetted by the melted temperature sensitive material (e.g., non-reactive or hardly reactive to the temperature sensitive material).

Further, it is more preferable that the lid or cylindrical case is made of a nonmagnetic or weakly magnetic material so as to prevent it from interacting with the peripheral members during operation. Furthermore, the lid and the cylindrical case are configured to be just brought into contact with each other when the strong compression spring and the weak compression spring are extended. Thereby, the lid is prevented from being strongly pressed against the cylindrical case after operation, which makes it possible to prevent the lid from tilting adversely.

Since the lid or the cylindrical case for housing the temperature sensitive material is made of a material that is hard to be wetted by the melted temperature sensitive material, when the temperature sensitive material is melted, due to its surface tension, the temperature sensitive material may be housed in the container with a minimum surface area. At this time, the temperature sensitive material is surrounded by the hard-to-wet surface of the lid and the cylindrical case and housed with a repulsion from the wall surface, and thereby, the metal material will not flow out of the cylindrical case due to the wetting phenomenon such as infiltrative wetting. For example, the temperature sensitive material may be housed in the container by utilizing the repelling property and the hard-to-wet property between the melted metal material and the wall surface surrounding the melted metal material. Thereby, even a slight gap is present in the container, the melted temperature sensitive material may be housed in the container without leaking to the outside.

Therefore, at least a portion of the lid or the cylindrical case that is in contact with the temperature sensitive material is made of a material (for example, a polymer material, aluminum, aluminum alloy, stainless steel, Fe—Ni alloy, a ceramic material, nickel, chromium) which is hard to be wetted by the melted temperature sensitive material. For example, the lid and the cylindrical case may be made of a composite material of an inorganic chemical material and a metal material, which is obtained, for example, by thermally spraying a ceramic material on the surface of a metal material.

The temperature sensitive material of the present disclosure is not particularly limited as long as it can melt at a predetermined temperature so as to provide the fuse function, for example, it may be a temperature sensitive metal made of pure tin (melting point 232° C.) or any one alloy of 67In-32.4Sn-0.6Cu alloy (melting point 124° C.), 56.5Bi-41.9Sn-1In-0.6Cu alloy (melting point 137° C.), 57Bi-43Sn alloy (melting point 139° C.), 52Bi-43Sn-5Sb alloy (melting point 146° C.), 91.2Sn-8.8Zn alloy (melting point 198° C.), 92.5Sn-4In-3Ag-0.5Bi alloy (melting point 208° C.), 96.5Sn-3.5Ag alloy (melting point 222° C.), 99.8Sn-0.2Cu alloy (melting point 227° C.), 95Sn-5Sb alloy (melting point 242° C.), 90Pb-10Sb alloy (melting point 252° C.), 99.3Bi-0.5Ag-0.2Cu alloy (melting point 262° C.), 97Bi-3Ag alloy (melting point 268° C.), 88.6Pb-9.5In-1Sn-0.9Ag alloy (melting point 289° C.), 98Pb-1.8Ag-0.2Sn alloy (melting point 310° C.), 93Zn-4Al-3Mg alloy (melting point 310° C.), 95Zn-5Al alloy (melting point 385° C.) in composition ratio (mass %). Each of these metal temperature sensitive materials is conductive.

As illustrated in FIG. 1, a temperature sensitive pellet type thermal fuse 10 according to a first embodiment of the present disclosure includes an envelope 11, a temperature sensitive device, an insulating tube 12, a first lead 14, a second lead 15, a movable contact 16, and a weak compression spring 17.

The envelope 11 is a cylinder made of silver-plated copper alloy, and is provided with an opening at a first end. The temperature sensitive device is housed inside the envelope 11, and is configured to be thermally actuated at 222° C.

The insulating tube 12 is made of ceramics, and is configured to close the opening of the envelope 11. The first lead 14 is made of silver-plated copper alloy. The first lead 14 penetrates the insulating tube 12, and an inner end thereof serves as a fixed contact 13. The second lead 15 is made of silver-plated copper alloy, and is disposed at a second end of the envelope 11.

The movable contact 16 is made of silver alloy. The movable contact 16 is housed in the envelope 11, and is configured to be pressed by the temperature sensitive device so as to abut the fixed contact 13. The weak compression spring 17 is housed in the envelope 11, and is configured to press the movable contact 16 in the direction of separating it from the fixed contact 13.

The temperature sensitive device includes a cylindrical case 100, a temperature sensitive material 101, a strong compression spring 102, a push plate 103, and a lid 104. The cylindrical case 100 is made of aluminum (coated with an anodized film formed from alumite coating), and is provided with an opening at one end. The temperature sensitive material 101 is housed in the cylindrical case 100, and is configured to melt at an operating temperature of 222° C. The temperature sensitive material 101 is made of 96.5 Sn-3.5Ag alloy. The strong compression spring 102 is configured to press the temperature sensitive material 101 so as to bring the movable contact 16 into contact with the fixed contact 13. The push plate 103 is made of SUS304 stainless steel, and is disposed between the strong compression spring 102 and the temperature sensitive material 101. The lid 104 is disposed to be sandwiched between the strong compression spring 102 and the movable contact 16, and is configured to close the opening of the cylindrical case 100 when the thermal fuse is in operation. The lid 104 is made of SUS304 stainless steel.

In the temperature sensitive pellet type thermal fuse 10 according to the first embodiment, the envelope 11 is sealed with a sealing material 1000 which is an organic adhesive. A curable resin or an elastomer may be used as the organic adhesive. More preferably, an epoxy resin or silicone rubber may be used as the organic adhesive. In the first embodiment, the push plate 103 is optional. In the first embodiment, the open end of the cylindrical case 100 is arranged to face the movable contact 16.

As illustrated in FIG. 1(*b*), when the temperature sensitive material 101 is melted, the biasing force for pressing the movable contact 16 toward the fixed contact 13 is weakened, and the weak compression spring 17 biases the movable contact 16 so as to separate it from the fixed contact 13. The lid 104 closes the opening of the cylindrical case 100 so as to prevent the melted temperature sensitive material 101 from flowing out of the cylindrical case 100.

Figure 2:
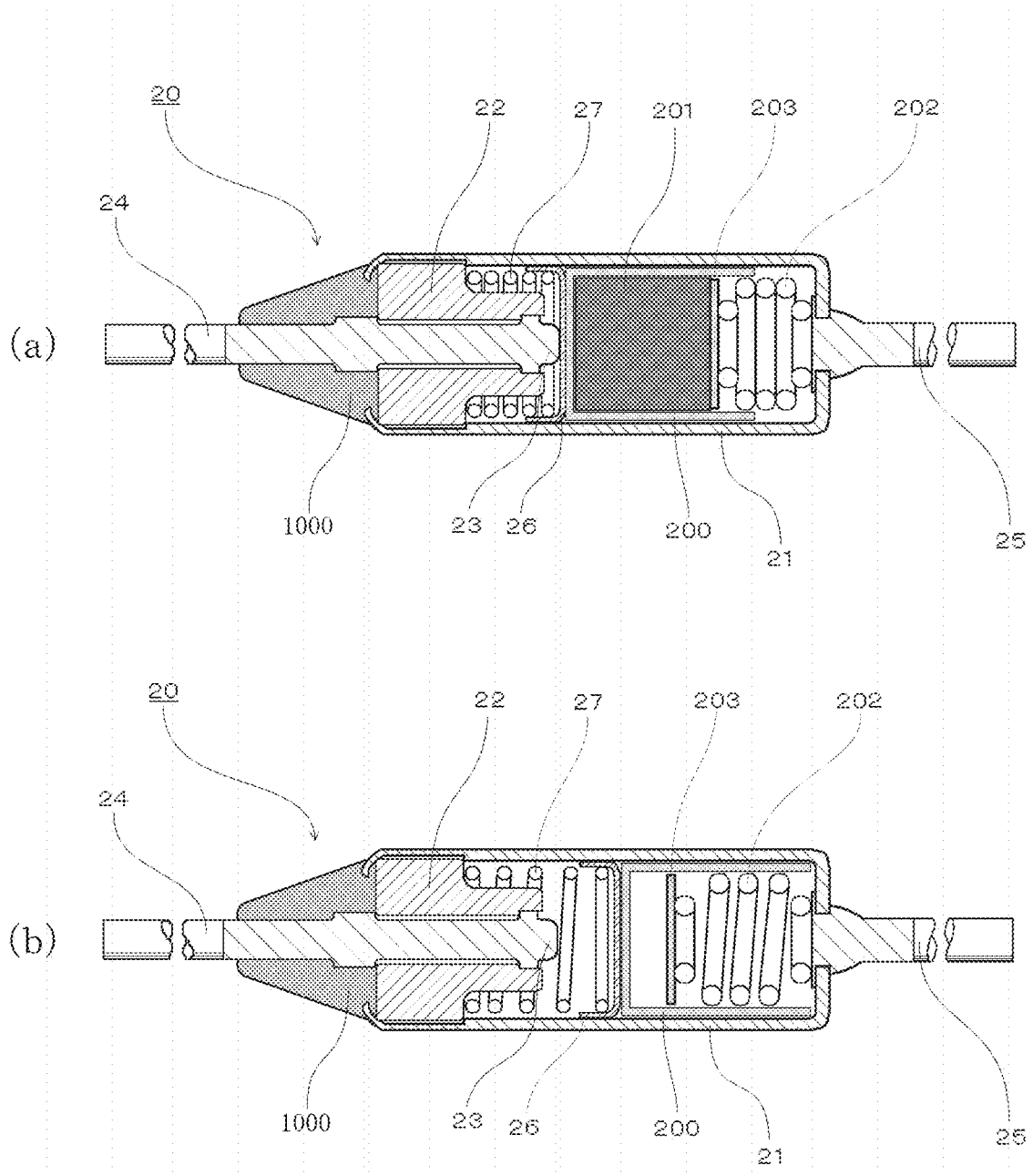
FIG. 2(*a*) is a cross-sectional view illustrating a temperature sensitive pellet type thermal fuse 20 according to an embodiment of the present disclosure before operation, and FIG. 2(*b*) is a cross-sectional view illustrating the temperature sensitive pellet type thermal fuse 20 after operation without depicting the temperature sensitive material.

As illustrated in FIG. 2, a temperature sensitive pellet type thermal fuse 20 according to a second embodiment of the present disclosure includes an envelope 21, a temperature sensitive device, an insulating tube 22, a first lead 24, a second lead 25, a movable contact 26, and a weak compression spring 27.

The envelope 21 is a cylinder made of silver-plated copper alloy, and is provided with an opening at a first end. The temperature sensitive device is housed inside the envelope 21, and is configured to be thermal actuated at 241° C. The insulating tube 22 is made of ceramics, and is configured to close the opening of the envelope 21.

The first lead 24 is made of silver-plated copper alloy. The first lead 24 penetrates the insulating tube 22, and an inner end thereof serves as a fixed contact 23. The second lead 25 is made of silver-plated copper alloy, and is disposed at a second end of the envelope 21. The movable contact 26 is made of silver alloy. The movable contact 26 is housed in the envelope 21, and is configured to be pressed by the temperature sensitive device so as to abut the fixed contact 23. The weak compression spring 27 is housed in the envelope 21, and is configured to press the movable contact 26 in the direction of separating it from the fixed contact 23.

The temperature sensitive means includes a cylindrical case 200, a temperature sensitive material 201, a strong compression spring 202, and a push plate 203.

The cylindrical case 200 is configured to close the open end thereof by pressing it against the inner end of the envelope 21 when the thermal fuse is in operation. The cylindrical case 200 is made of SUS304 stainless steel. The temperature sensitive material 201 is housed in the cylindrical case 200, and is made of 95Sn-5Sb alloy which melts at an operating temperatures of 241° C. The strong compression spring 202 is configured to press the temperature sensitive material 201 so as to bring the movable contact 26 into contact with the fixed contact 23. The push plate 203 is made of SUS304 stainless steel, and is disposed to be sandwiched between the strong compression spring 202 and the temperature sensitive material 201.

In the temperature sensitive pellet type thermal fuse 20 according to the second embodiment, the envelope 21 is sealed with a sealing material 1000 which is an organic adhesive. In the second embodiment, the push plate 203 is optional. In the second embodiment, the open end of the cylindrical case 200 is arranged at the side of the second lead 25.

Figure 3:
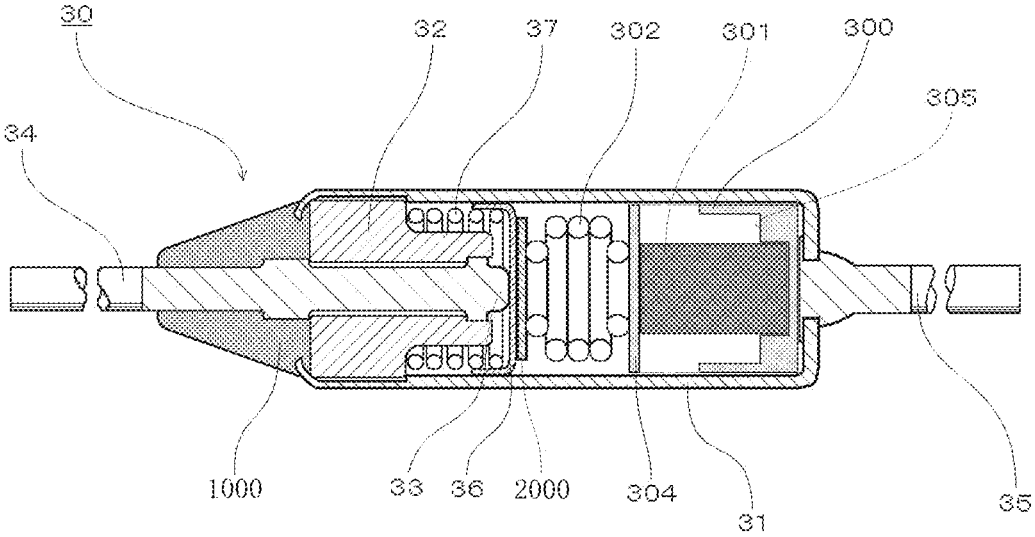
FIG. 3(*a*) is a cross-sectional view illustrating a temperature sensitive pellet type thermal fuse 30 according to an embodiment of the present disclosure before operation, and FIG. 3(*b*) is a cross-sectional view illustrating the temperature sensitive pellet type thermal fuse 30 after operation.
Figure 3:
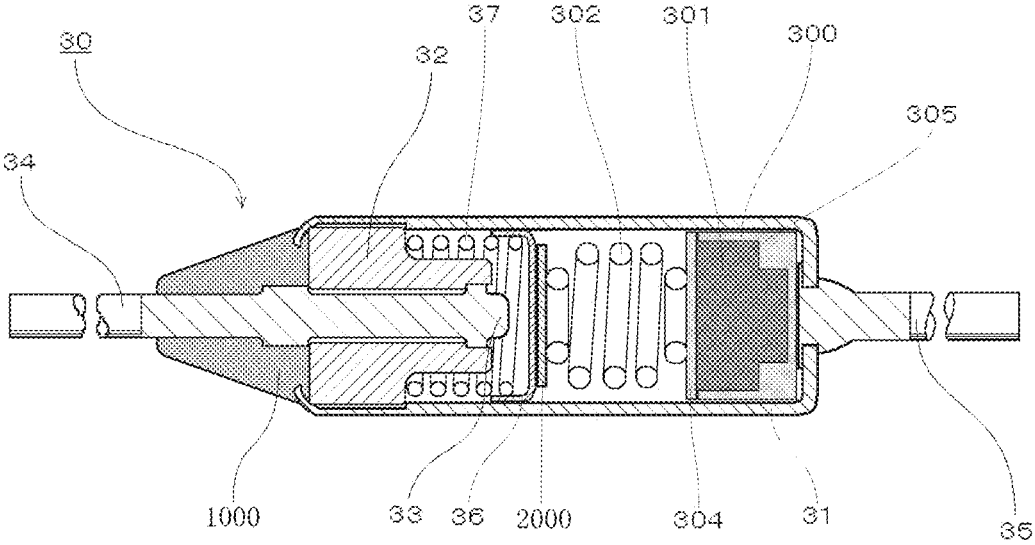

As illustrated in FIG. 3, a temperature sensitive pellet type thermal fuse 30 according to a third embodiment of the present disclosure includes an envelope 31, a temperature sensitive device, an insulating tube 32, a first lead 34, a second lead 35, a movable contact 36, and a weak compression spring 37.

The envelope 31 is a cylinder made of silver-plated copper alloy, and is provided with an opening at a first end. The temperature sensitive device is housed inside the envelope 31, and is configured to be thermally actuated at 292° C. The insulating tube 32 is made of ceramics, and is configured to close the open end of the envelope 31.

The first lead 34 is made of silver-plated copper alloy. The first lead 34 penetrates the insulating tube 32, and an inner end thereof serves as a fixed contact 33. The second lead 35 is made of silver-plated copper alloy, and is disposed at a second end of the envelope 31. The movable contact 36 is made of silver alloy. The movable contact 36 is housed in the envelope 31, and is configured to be pressed by the temperature sensitive device so as to abut the fixed contact 33. The weak compression spring 37 is housed in the envelope 31, and is configured to press the movable contact 36 in the direction of separating it from the fixed contact 33.

The temperature sensitive device includes a cylindrical case 300, a temperature sensitive material 301, a lid 304, and a strong compression spring 302. The cylindrical case 300 is made of ceramics. The temperature sensitive material 301 is housed in the cylindrical case 300, and is made of 95Sn-5Sb alloy which melts at 242° C.

The lid 304 is disposed to be sandwiched between the temperature sensitive material 301 and the strong compression spring 302. The strong compression spring 302 is housed in the envelope 31, and is configured to press the temperature sensitive material so as to bring the movable contact 36 into contact with the fixed contact 33.

In the temperature sensitive pellet type thermal fuse 30 according to the third embodiment, the envelope 31 is sealed with a sealing material 1000 which is an organic adhesive, and is provided with a disc 2000 that is sandwiched between the movable contact 36 and the strong compression spring 302. Further, in order to form a gap between the temperature sensitive material 301 and the inner wall of the cylindrical case 300, a step 305 may be provided on the inner bottom of the cylindrical case.

Figure 4:
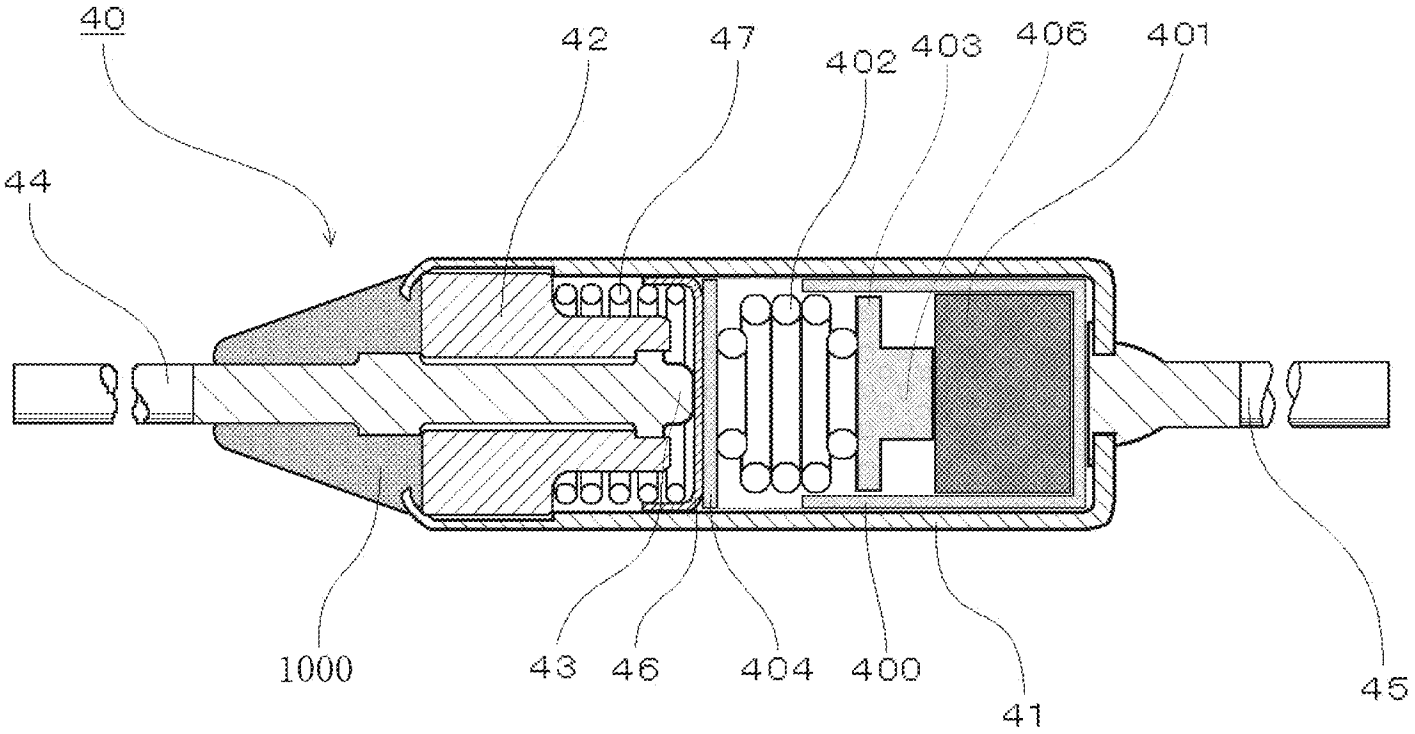
FIG. 4 is a cross-sectional view illustrating a temperature sensitive pellet type thermal fuse according to a first modification of the present disclosure.

The push plate 103 in the temperature sensitive pellet type thermal fuse 10 may be modified into the shape of a push plate 403 of the temperature sensitive pellet type thermal fuse 40 as illustrated in FIG. 4 according to a first modification. The push plate 403 may be provided with a columnar projection 406 on a contact surface in contact with the temperature sensitive material 401. The projection 406 of the push plate 403 according to the first modification is configured to abut against the temperature sensitive material 401 at the tip and so as to form a gap between the outer periphery of the projection 406 and the inner wall of the cylindrical case 400. After the temperature sensitive material is melted, the projection 406 is buried in the melted temperature sensitive material. At this time, the melted temperature sensitive material 401 flows so as to fill the gap between the projection 406 and the inner wall of the cylindrical case 400, preventing the temperature sensitive material 401 from being ejected out of the cylindrical case 400.

Figure 5:
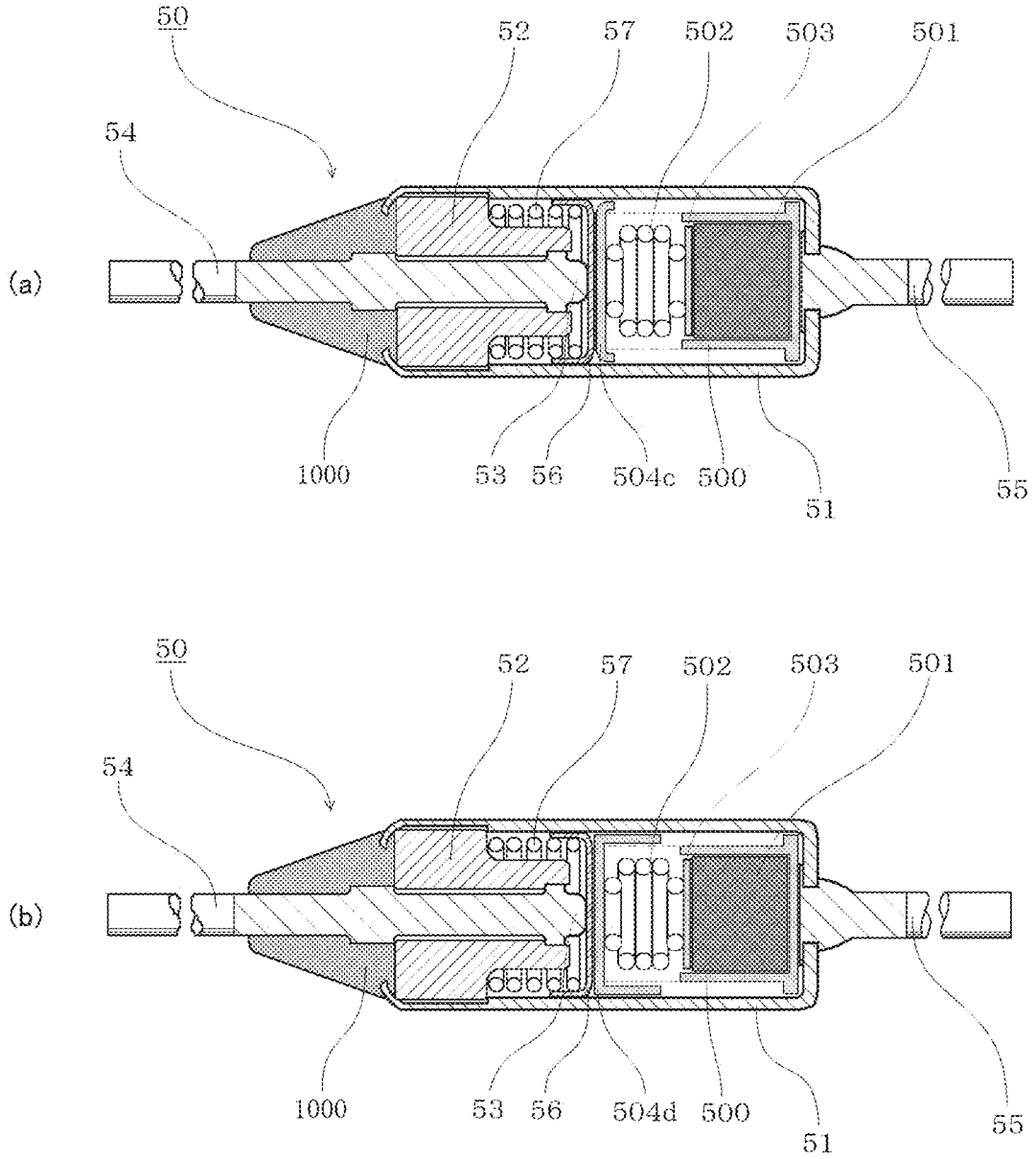
FIG. 5 is a cross-sectional view illustrating a temperature sensitive pellet type thermal fuse according to a second modification of the present disclosure.

The lid 104 of the temperature sensitive pellet type thermal fuse 10 may be modified to have a dish shape such as a lid 504*c* of the temperature sensitive pellet type thermal fuse as illustrated in FIG. 5(*a*) according to a second modification. The lid may also be modified to have a cap shape such as a lid 504*d* as illustrated in FIG. 5(*b*). The dish-shaped lid 504*c* or the cap-shaped lid 504*d* is configured to close the open end of the cylindrical case 500 after operation.

Figure 6:
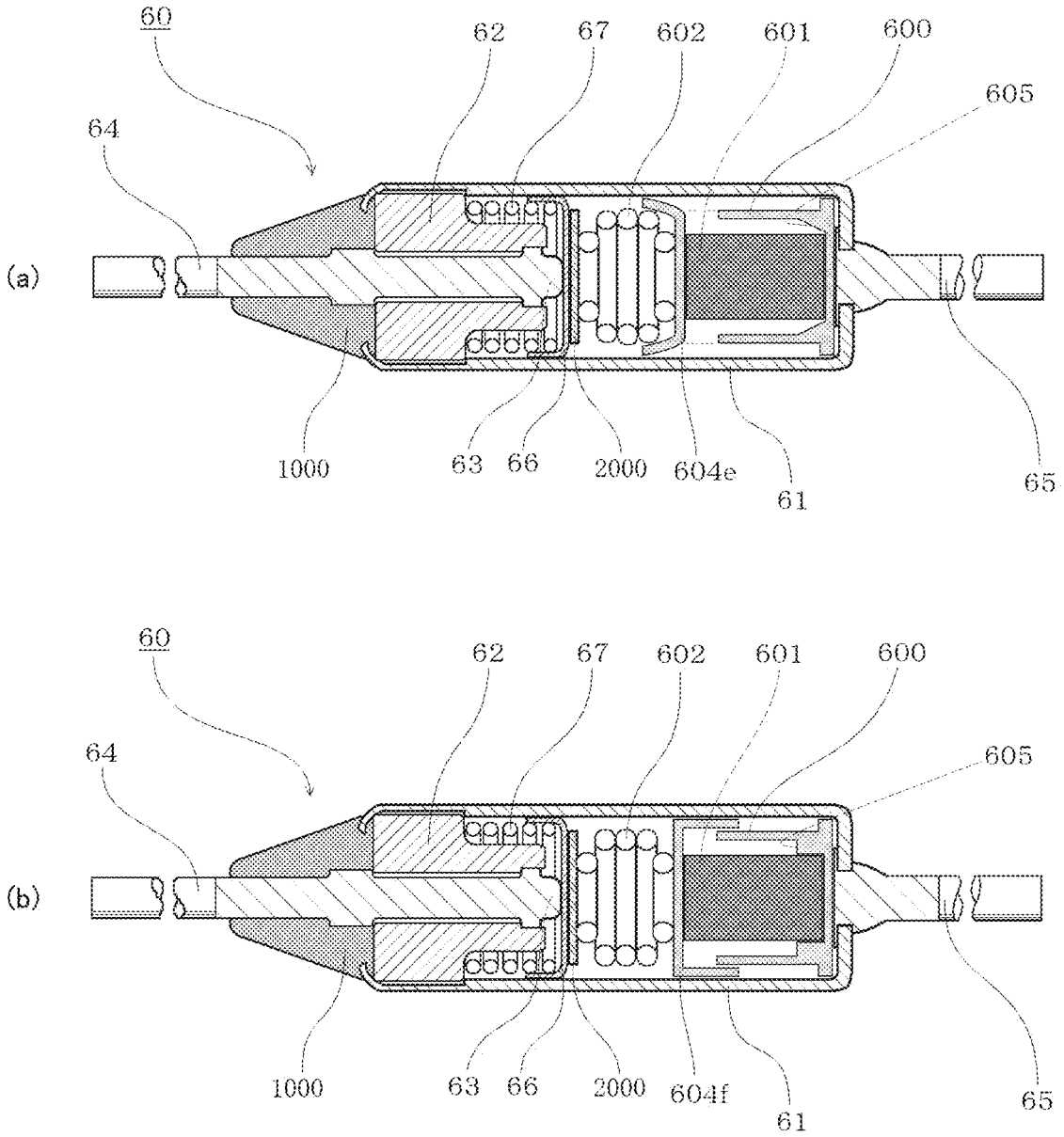
FIG. 6 is a cross-sectional view illustrating a temperature sensitive pellet type thermal fuse according to a third modification of the present disclosure.

The lid 304 of the temperature sensitive pellet type thermal fuse 30 according to the present invention may be modified to have a dish shape such as a lid 604*e* of the temperature sensitive pellet type thermal fuse as illustrated in FIG. 6(*a*) according to a third modification. The lid may also be modified to have a cap shape such as a lid 604*f* illustrated in FIG. 6(*b*). The dish-shaped lid 604*e* or the cap-shaped lid 604*f* is configured to close at least the open end of the cylindrical case 600 after operation.

As illustrated in FIG. 6(*b*), by providing a suitable gap between the lid 604*f* and the outer peripheral wall of the cylindrical case 600, it is possible to prevent the inner wall of the lid 604*f* from interfering with the outer peripheral wall of the cylindrical case 600. As illustrated in FIG. 6(*b*), the cylindrical case 600 and the lid 604*f* may be joined to each other so as to form a capsule before operation.

As illustrated in FIG. 6(*a*), the step 605 may be tapered so that the temperature sensitive material may be easily mounted on the center of the bottom surface of the cylindrical case. The dish-shaped lid 604*e* may be disposed in two different directions, that is, in one direction where the upper surface of the dish abuts against the strong compression spring 602 as illustrated in FIG. 6(*a*), and in the other direction where the back surface of the dish abuts against the strong compression spring 602.

Figure 7:
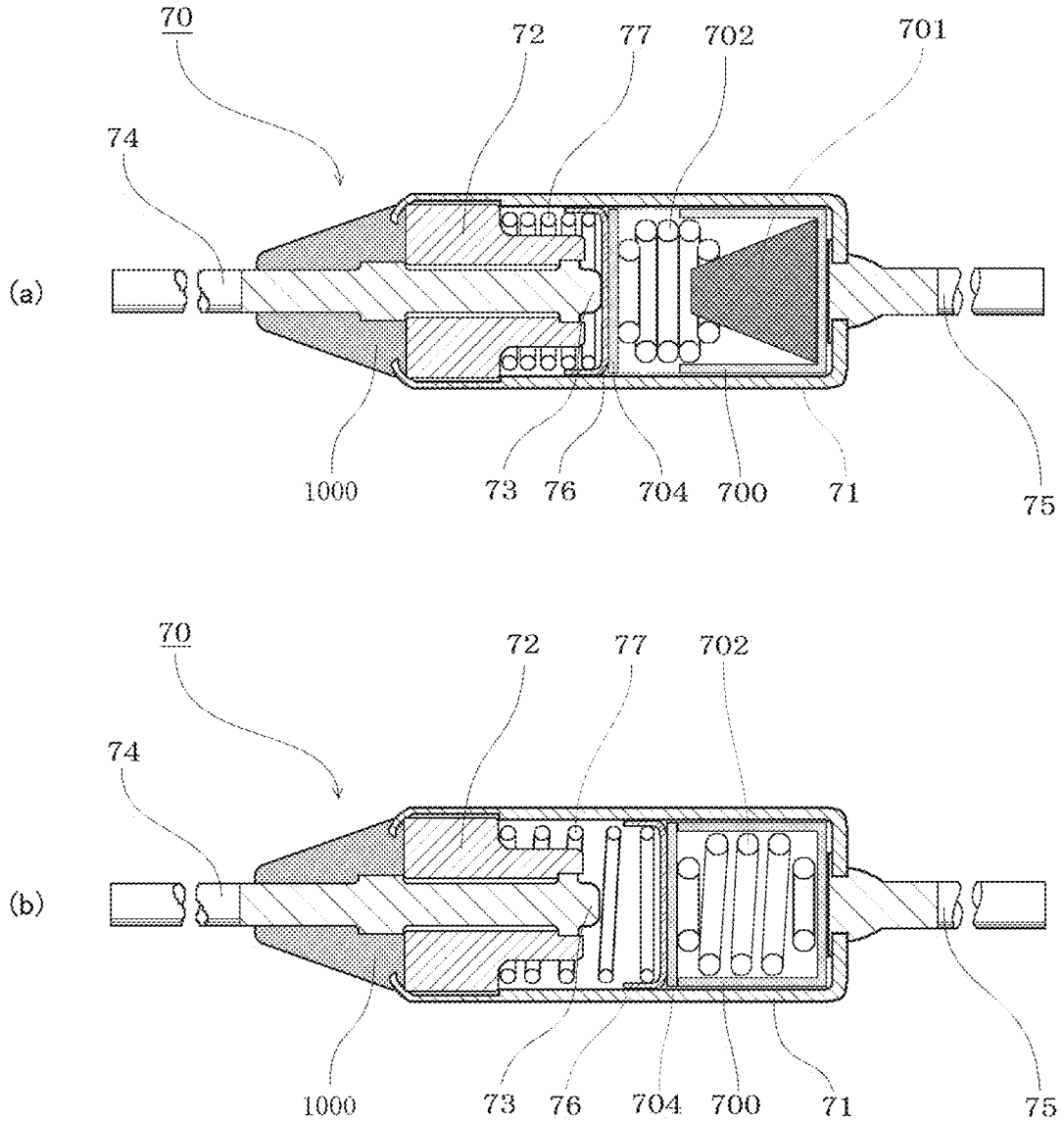
FIG. 7(*a*) is a cross-sectional view illustrating a temperature sensitive pellet type thermal fuse according to a fourth modification of the present disclosure before operation, and FIG. 7(*b*) is a cross-sectional view illustrating the temperature sensitive pellet type thermal fuse according to a fourth modification of the present disclosure after operation without depicting the temperature sensitive material.

The temperature sensitive material 101 of the temperature sensitive pellet type thermal fuse 10 may be modified into the shape of a truncated cone such as the temperature sensitive material 701 of a temperature sensitive pellet type thermal fuse 70 as illustrated in FIG. 7(*a*) according to a fourth modification. Alternatively, the temperature sensitive material 701 may be modified into the shape of a cone. As illustrated in the figure, an upper portion of the temperature sensitive material 701 in the shape of a cone or a truncated cone may be fitted into the hole of the strong compression spring 702, which makes it possible to make the thermal fuse smaller. In addition, since the strong compression spring 702 is easy to be positioned, it is easy to assemble the thermal fuse.

For the conventional temperature sensitive material which is made of organic chemical material, when it is installed into the hole, the spring load is concentrated on the contact portion, which may deform or break the temperature sensitive material, and thereby, the cone or truncated cone shape as described in the fourth modification is not applicable. The temperature sensitive material is preferably made of an inorganic material such as a metal material which is hard to deform other than the organic chemical material.

Figure 8:
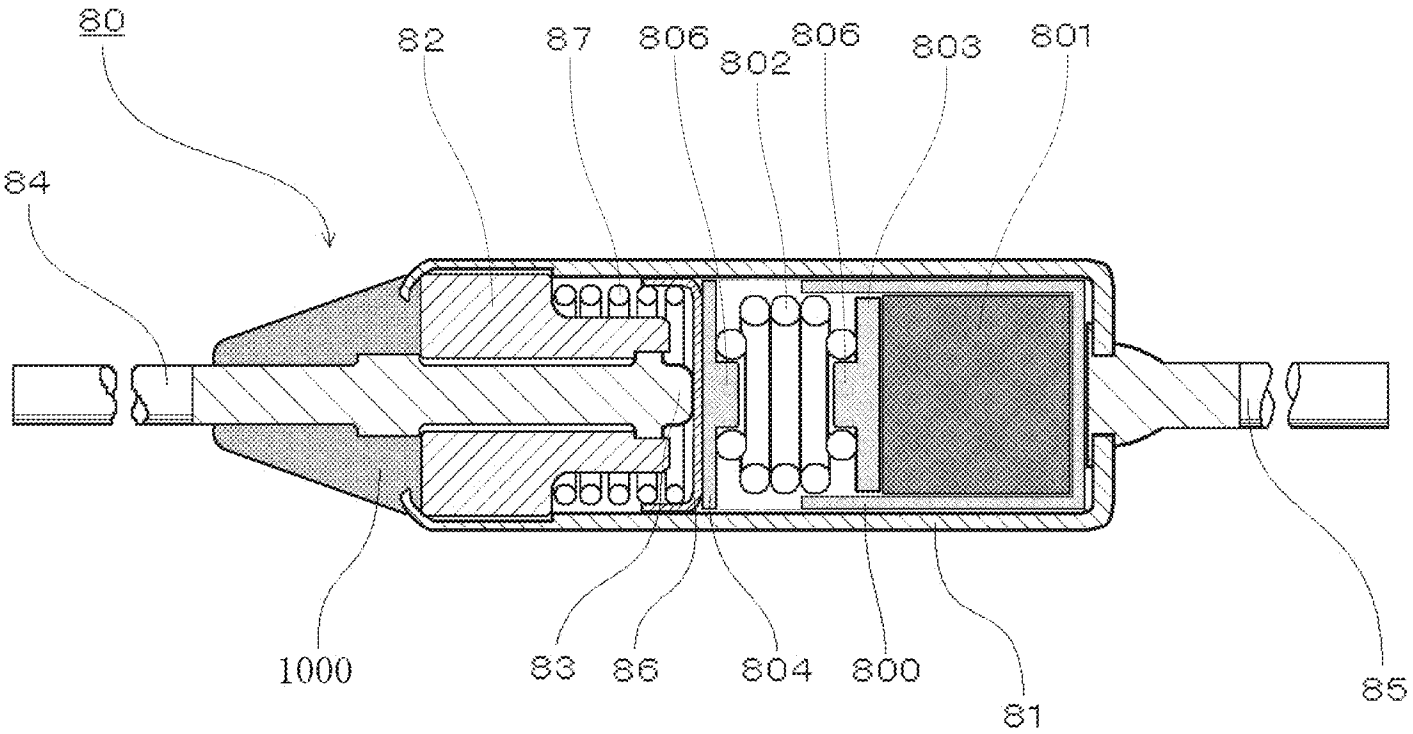
FIG. 8 is a cross-sectional view illustrating a temperature sensitive pellet type thermal fuse according to a fifth modification of the present disclosure.

The push plate 103 and the lid 104 of the temperature sensitive pellet type thermal fuse 10 may modified respectively into the shape of a push plate 803 and a lid 804 of a temperature sensitive pellet type thermal fuse 80 as illustrated in FIG. 8 according to a fifth modification. Each of the push plate 803 and the lid 804 may be provided with a columnar projection 806 that matches with the inner diameter (the spring hole) of the strong compression spring 802. The push plate 803 and the lid 804 are modified to have a convex shape by providing the projection 806.

By providing the projection 806, it is possible to prevent the misalignment of the push plate 803, the lid 804 and the strong compression spring 802, which makes it possible to improve the connection or the linkage between the push plate 803, the lid 804 and the strong compression spring 802. Although as illustrated in FIG. 8, the projection 806 is provided on both of the push plate 803 and the lid 804, it may be provided on any one of the push plate 803 and the lid 804.

It is preferable that the strong compression spring in any one of the embodiments mentioned above is configured in such a manner that when the inner diameter of the cylindrical case into which the strong compression spring is inserted is set to 1, the outer diameter of the strong compression spring is in the range of 0.90 to 0.97. If the outer diameter ratio of the strong compression spring is less than 0.90, the strong compression spring easily inclines inside the cylindrical case, which makes it difficult to press the temperature sensitive material appropriately. If the outer diameter ratio of the strong compression spring is greater than 0.97, the strong compression spring will abut strongly against the inner wall of the cylindrical case, which prevents the spring from extending normally.

In any one of the embodiments mentioned above, it is preferable that at least a portion of the lid in contact with the cylindrical case is made of an elastic material having elasticity. The elastic material constituting the lid is not limited to metal. For example, in order to easily seal the open end of the cylindrical case, the entire lid or at least the outer peripheral portion of the lid or a portion in contact with the cylindrical case may be made of liquid crystal plastic (LCP), a heat-resistant resin such as fluorine resin, or a polymer material such as fluorine rubber.

The lid may be made of a composite material, for example, a composite material of a polymer material and an inorganic chemical material such as glass reinforced plastic (FRP). Furthermore, for example, at least a portion of the outer peripheral edge of a metal lid in contact with the cylindrical case may be covered with resin by insert molding. At least a portion of the metal lid in contact with the cylindrical case may be coated with elastic rubber or resin. Thus, the lid may be made of a composite material of a polymer material and a metal.

Thereby, when the lid contacts the cylindrical case, at least the outer peripheral portion of the lid is pressed by the weak compression spring to undergo elastic deformation, which makes it possible to reliably seal the opening of the cylindrical case.

In any one of the embodiments mentioned above, the entire cylindrical case or at least the outer periphery of the open end of the cylindrical case or a portion of the cylindrical case in contact with the lid may be made of liquid crystal plastic (LCP), a heat-resistant resin such as fluorine resin, or a polymer material such as fluorine rubber, or an inorganic material such as ceramics.

Figure 9:
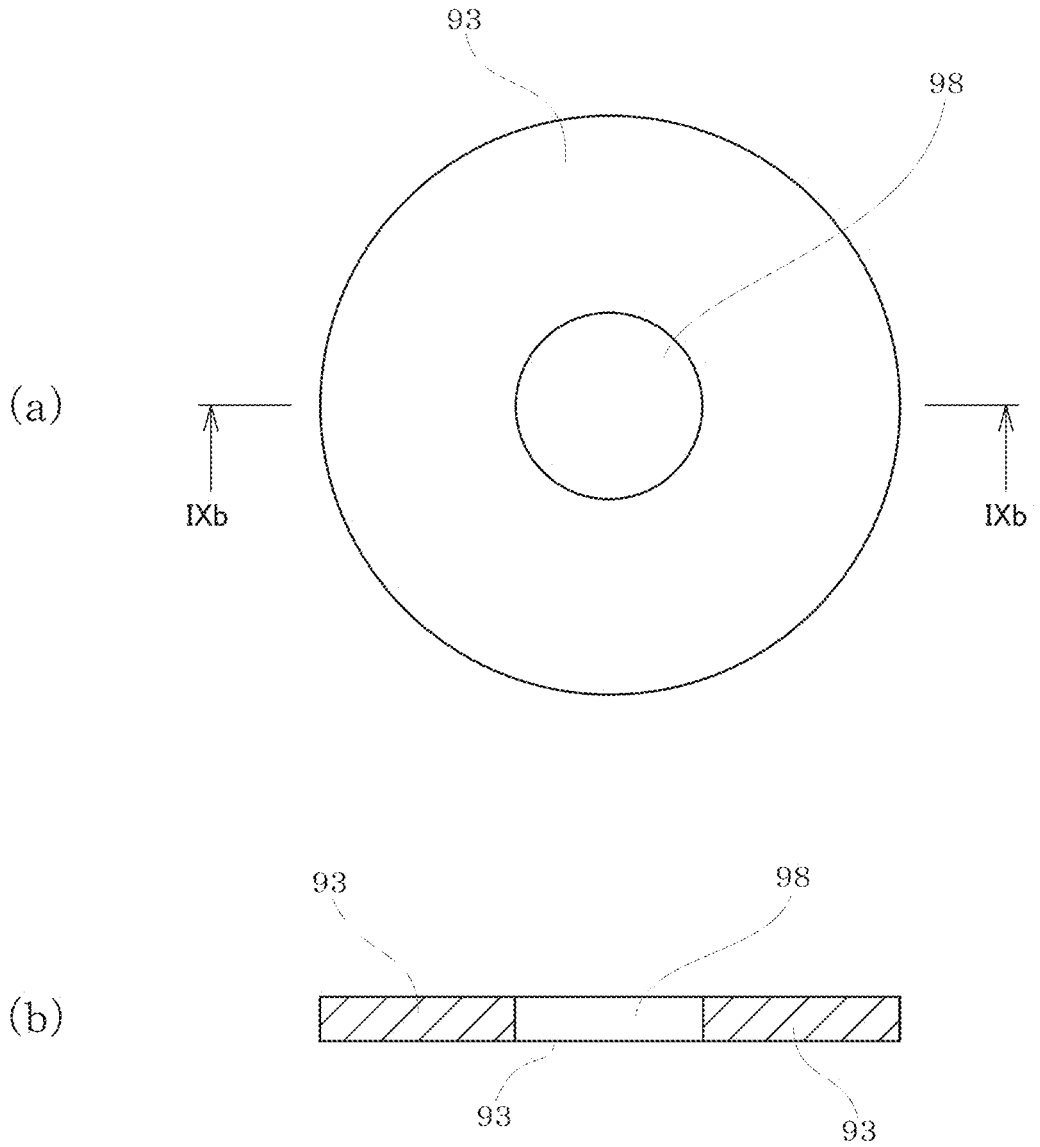
FIG. 9(*a*) is a plan view illustrating a push plate of a temperature sensitive pellet type thermal fuse according to an embodiment of the present disclosure, and FIG. 9(*b*) a cross-sectional view thereof taken along a line IXb-IXb in FIG. 9(*a*)

The push plate used in the temperature sensitive pellet type thermal fuse of the present embodiment may be configured to control the flow direction, the ejection amount, or the ejection position of the melted temperature sensitive material. For example, as illustrated in FIG. 9, a push plate 93 may be provided with a flow hole 98 for the melted temperature sensitive material to flow through. By adjusting the flow direction and the ejection amount of the melted temperature sensitive material via the flow hole 98, the melted temperature sensitive material may be prevented from flowing out of the cylindrical case after operation.

The push plate 93 may be provided with at least one or more flow holes 98. For example, the push plate may be provided with one flow hole in the center as illustrated in FIG. 9 or a plurality of flow holes. The position, the size, the shape or the like of the flow hole 98 may be modified according to the thermal flow characteristics of the temperature sensitive material to be used.

Figure 10:
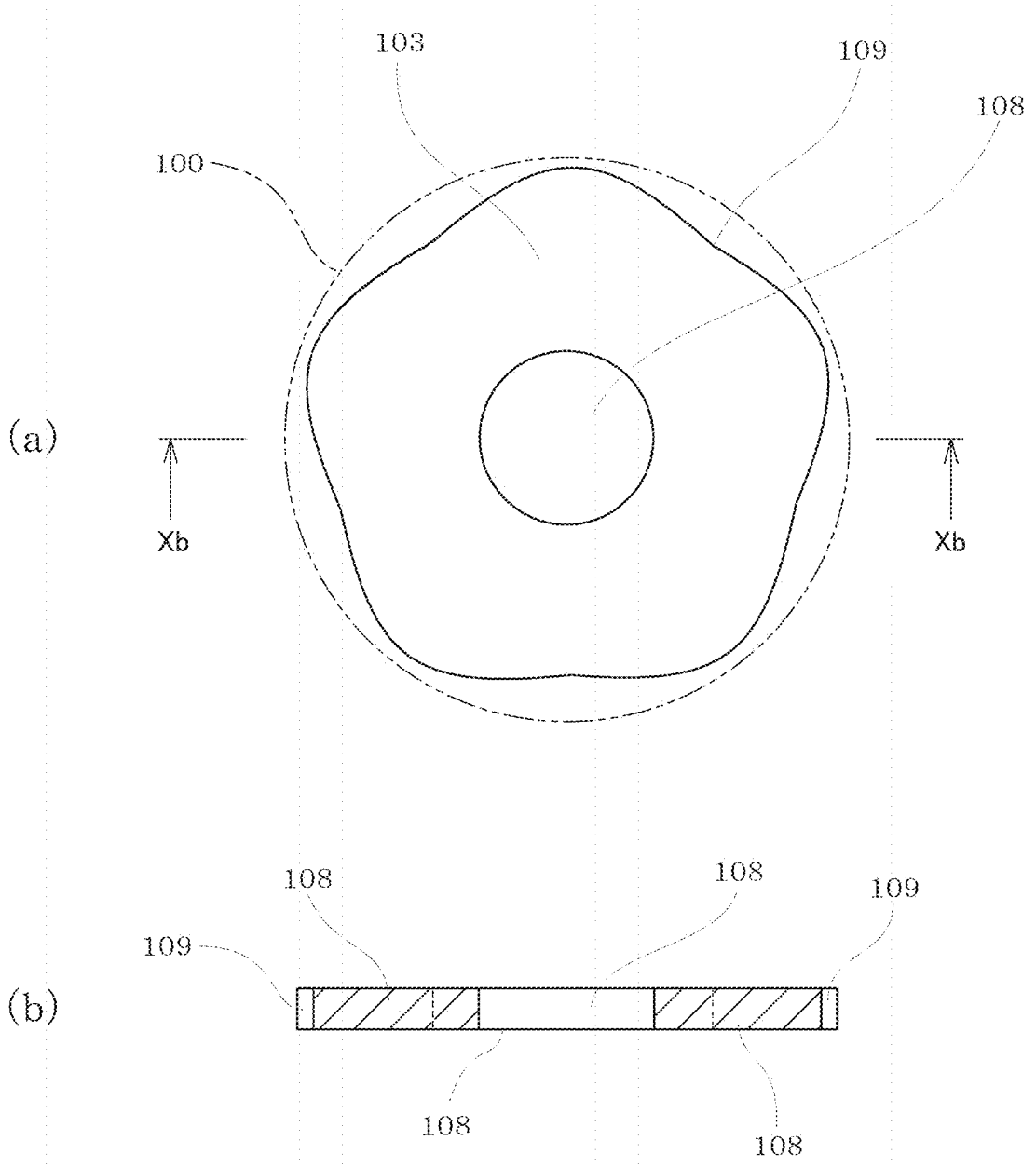
FIG. 10(*a*) is a plan view illustrating a push plate of a temperature sensitive pellet type thermal fuse according to an embodiment of the present disclosure, and FIG. 10(*b*) a cross-sectional view thereof taken along a line Xb-Xb in FIG. 10(*a*)
Figure 11:
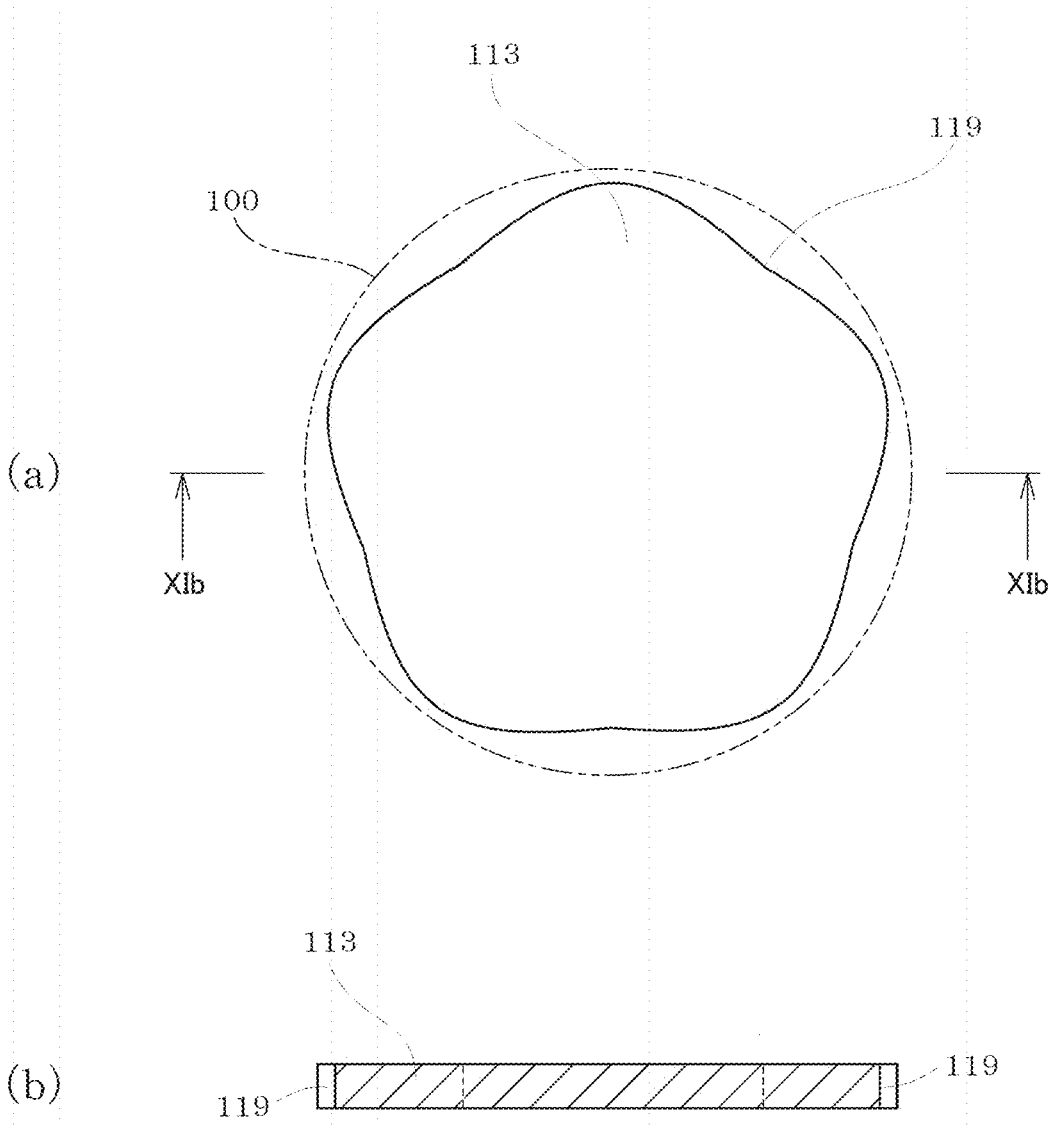
FIG. 11(*a*) is a plan view illustrating a push plate of a temperature sensitive pellet type thermal fuse according to an embodiment of the present disclosure, and FIG. 11(*b*) a cross-sectional view thereof taken along a line XIb-XIb in FIG. 11(*a*).

As illustrated in FIGS. 10 and 11, the flow direction and the ejection amount of the melted temperature sensitive material may be controlled by designing the push plates 103 and 113 into a polygonal shape, a star shape, a flower shape or the like. The same effect as the above-described flow hole may be obtained by providing a notch 109 in the outer periphery of the push plate 103 or a notch 119 in the outer periphery of the push plate 113 so as to adjust the opening between the push plate 103 or 113 and the inner wall of the cylindrical case 100. In this case, it is preferable that the corners of the push plate are rounded so that it is difficult to be caught in the cylindrical case. As illustrated in FIG. 10, the flow hole 108 and the notch 109 may be provided in combination.

A conductive temperature sensitive material may be used in temperature sensitive pellet type thermal fuse of the present embodiment without inhibiting the separation of the movable contact. In particular, the material and shape may be stably maintained even when exposed to a high temperature environment around 200° C. for a long time. For example, it is possible to provide a temperature sensitive pellet type thermal fuse which is highly reliable after operation in terms of insulation.

It should be understood that the embodiments and the examples disclosed herein have been presented for the purpose of illustration and description but not limited in all aspects. It is intended that the scope of the present invention is not limited to the description above but defined by the scope of the claims and encompasses all modifications equivalent in meaning and scope to the claims.

INDUSTRIAL APPLICABILITY

The present disclosure is advantageously applicable to a contact separating type thermal fuse which is provided with a movable contact and configured to separate the contacts when an abnormal temperature is sensed, and is especially applicable to a temperature sensitive pellet type thermal fuse.

REFERENCE SIGNS LIST

10, 20, 30, 40, 60, 70, 80: temperature sensitive pellet type thermal fuse; 11, 21, 31: envelope; 12, 22, 32: insulating tube; 13, 23, 33: fixed contact; 14, 24, 34: first lead; 15, 25, 35: second lead; 16, 26, 36: movable contact; 17, 27, 37: weak compression spring; 93, 103, 203, 403, 803: push plate; 98, 108: flow hole; 100, 200, 300, 400, 500, 600: cylindrical case; 101, 201, 301, 401, 701: temperature sensitive material; 102, 202, 302, 602, 702, 802: strong compression spring; 104, 304, 504*c*, 504*d*, 604*e*, 604*f*, 804: lid; 109: notch; 305, 605: step; 406, 806: projection; 1000: sealing material; 2000: disc

The invention claimed is:

1. A temperature sensitive pellet type thermal fuse comprising:

an envelope which is conductive, and has an opening at a first end of the envelope;

a temperature sensitive device which is housed inside the envelope, and is configured to be thermally actuated at a predetermined temperature so as to switch the temperature sensitive pellet type thermal fuse from a closed circuit state to an open circuit state thereof;

a first lead which is installed in the opening at the first end of the envelope, and is electrically insulated from the envelope, and has a fixed contact inside the envelope;

a second lead which is connected to a second end of the envelope;

a movable contact which is movably housed in and electrically contacts the envelope, and is configured to be pressed by the temperature sensitive device so as to abut against the fixed contact in the closed circuit state; and a weak compression spring which is housed in the envelope, and is configured to press the movable contact in a first direction of separating the movable contact from the fixed contact;

wherein the temperature sensitive device includes:

a cylindrical case having an open end;

a temperature sensitive material which is housed in the cylindrical case, and is configured to melt at the predetermined temperature; and a strong compression spring which is stronger than the weak compression spring, and is configured to press against the temperature sensitive material and to press the movable contact in a second direction opposite the first direction so as to bring the movable contact into electrical contact with the fixed contact in the closed circuit state; and wherein the temperature sensitive device is configured and arranged so that the open end of the cylindrical case is closed in the open circuit state to prevent leaking of the temperature sensitive material out of the cylindrical case after the temperature sensitive material has melted at the predetermined temperature.

2. The temperature sensitive pellet type thermal fuse according to claim 1, wherein the open end of the cylindrical case of the temperature sensitive device is arranged facing toward the second lead, and the cylindrical case has a closed end opposite the open end.

3. The temperature sensitive pellet type thermal fuse according to claim 1, wherein the temperature sensitive device further includes a lid which is arranged outside of and directly contacting the open end of the cylindrical case in the open circuit state, and is arranged outside of and spaced apart from the open end of the cylindrical case in the closed circuit state.

4. The temperature sensitive pellet type thermal fuse according to claim 3, wherein the lid is arranged directly between and in direct contact with the temperature sensitive material and the strong compression spring.

5. The temperature sensitive pellet type thermal fuse according to claim 3, wherein at least a portion of the lid in direct contact with the open end of the cylindrical case in the open circuit state consists of an elastic material.

6. The temperature sensitive pellet type thermal fuse according to claim 5, wherein the elastic material is a polymer material or a metal material.

7. The temperature sensitive pellet type thermal fuse according to claim 5, wherein the portion of the lid in direct contact with the open end of the cylindrical case in the open circuit state consists of the elastic material which is insert-molded onto a metal material of a remainder of the lid.

8. The temperature sensitive pellet type thermal fuse according to claim 5, wherein the portion of the lid in direct contact with the open end of the cylindrical case in the open circuit state consists of the elastic material which is elastically coated onto a metal material of a remainder of the lid.

9. The temperature sensitive pellet type thermal fuse according to claim 3, wherein the lid consists of a composite of an inorganic chemical material and a polymer material.

10. The temperature sensitive pellet type thermal fuse according to claim 3, wherein the lid consists of a composite of a metal material and a polymer material.

11. The temperature sensitive pellet type thermal fuse according to claim 3, wherein the lid is dish-shaped or cap-shaped.

12. The temperature sensitive pellet type thermal fuse according to claim 3, wherein the lid is configured to close the open end of the cylindrical case in the open circuit state by directly contacting and seating against the open end of the cylindrical case.

13. The temperature sensitive pellet type thermal fuse according to claim 3, wherein at least one of the lid and the cylindrical case consists of a material which resists wetting by the temperature sensitive material after melting thereof.

14. The temperature sensitive pellet type thermal fuse according to claim 3, wherein at least one of the lid and the cylindrical case consists of a material which is non-reactive or not significantly reactive to the temperature sensitive material.

15. The temperature sensitive pellet type thermal fuse according to claim 3, wherein at least one of the lid and the cylindrical case consists of a nonmagnetic or weak magnetic material.

16. The temperature sensitive pellet type thermal fuse according to claim 3, wherein the lid contacts, closes and seals the open end of the cylindrical case in the open circuit state.

17. The temperature sensitive pellet type thermal fuse according to claim 3, wherein the lid is arranged always outside of the cylindrical case and does not fit into the cylindrical case.

18. The temperature sensitive pellet type thermal fuse according to claim 17, wherein the strong compression spring is arranged between the lid and the movable contact, and the temperature sensitive material remains separated from the strong compression spring by the lid in the closed circuit state and the open circuit state.

19. The temperature sensitive pellet type thermal fuse according to claim 3, wherein the lid has a cylindrical rim or flange that extends circumferentially around an outer cylindrical surface of the open end of the cylindrical case in the open circuit state.

20. The temperature sensitive pellet type thermal fuse according to claim 1, wherein the temperature sensitive material is a conductive metal material.

21. The temperature sensitive pellet type thermal fuse according to claim 1, wherein the temperature sensitive device further includes a push plate disposed between the temperature sensitive material and the strong compression spring in the closed circuit state.

22. The temperature sensitive pellet type thermal fuse according to claim 21, wherein the push plate includes a plate member and a projection which projects from the plate member toward the temperature sensitive material and has a contact surface that directly contacts the temperature sensitive material in the closed circuit state.

23. The temperature sensitive pellet type thermal fuse according to claim 21, wherein an outer peripheral contour of the push plate has a polygonal shape, a star shape or a flower shape.

24. The temperature sensitive pellet type thermal fuse according to claim 21, wherein the push plate has a notch in an outer peripheral edge thereof.

25. The temperature sensitive pellet type thermal fuse according to claim 1, wherein the temperature sensitive material is shaped as a cone or a truncated cone in the closed circuit state.

26. The temperature sensitive pellet type thermal fuse according to claim 25, wherein only an upper portion of the temperature sensitive material shaped as a cone or a truncated cone is fitted in a hole of the strong compression spring in the closed circuit state.

27. The temperature sensitive pellet type thermal fuse according to claim 1, wherein a ratio of an outer diameter of the strong compression spring to an inner diameter of the cylindrical case is in a range from 0.90 to 0.97.

28. The temperature sensitive pellet type thermal fuse according to claim 1, wherein the open end of the cylindrical case of the temperature sensitive device is arranged of facing toward the first lead, and the cylindrical case has a closed end opposite the open end.

29. The temperature sensitive pellet type thermal fuse according to claim 1, wherein the open end of the cylindrical case contacts and is closed and sealed against an inner wall surface of the envelope at the second end thereof in the open circuit state.

30. The temperature sensitive pellet type thermal fuse according to claim 1, wherein the cylindrical case has a closed end opposite the open end, the closed end of the cylindrical case is arranged contacting the movable contact, and the cylindrical case is movably arranged in the envelope so as to move together with the movable contact when switching from the closed circuit state to the open circuit state.

31. The temperature sensitive pellet type thermal fuse according to claim 1, wherein the cylindrical case contains only the temperature sensitive material, and the strong compression spring is arranged and remains outside of the cylindrical case in both the closed circuit state and the open circuit state.

32. The temperature sensitive pellet type thermal fuse according to claim 1, wherein there is a void space devoid of the temperature sensitive material inside the cylindrical case in the closed circuit state, and wherein either the temperature sensitive material is configured not to fill an entire volume of the cylindrical case so as to thereby leave the void space within the cylindrical case in the closed circuit state, or the push plate is configured with a projection that contacts the temperature sensitive material and forms the void space around the projection within the cylindrical case in the closed circuit state.

* * * * *